US010906766B2

(12) United States Patent
Ito

(10) Patent No.: US 10,906,766 B2
(45) Date of Patent: Feb. 2, 2021

(54) SHEET DISCHARGING APPARATUS AND IMAGE READING APPARATUS

(71) Applicant: CANON KABUSHIKI KAISHA, Tokyo (JP)

(72) Inventor: Akihiro Ito, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 16/185,780

(22) Filed: Nov. 9, 2018

(65) Prior Publication Data

US 2019/0144229 A1 May 16, 2019

(30) Foreign Application Priority Data

Nov. 10, 2017 (JP) ..... 2017-217797

(51) Int. Cl.

| | |
|---|---|
| ***B65H 31/00*** | (2006.01) |
| ***B65H 29/14*** | (2006.01) |
| ***B65H 43/02*** | (2006.01) |
| ***B65H 31/02*** | (2006.01) |

(52) U.S. Cl.

CPC ..... *B65H 31/00* (2013.01); *B65H 29/14* (2013.01); *B65H 31/02* (2013.01); *B65H 43/02* (2013.01); *B65H 2301/4212* (2013.01); *B65H 2301/5133* (2013.01); *B65H 2401/211* (2013.01); *B65H 2404/5331* (2013.01); *B65H 2511/51* (2013.01); *B65H 2515/716* (2013.01); *B65H 2801/06* (2013.01)

(58) Field of Classification Search

CPC ..... B65H 2301/5133; B65H 2515/716; B65H 2301/5321; B65H 2404/5331; B65H 2401/211; B65H 7/02; B65H 7/04; B65H 2553/612; G03G 2215/00649

See application file for complete search history.

(56) References Cited

U.S. PATENT DOCUMENTS

| | | | | |
|---|---|---|---|---|
| 6,505,829 | B2 * | 1/2003 | Kawata | B65H 31/00 271/208 |
| 7,364,155 | B2 * | 4/2008 | Nagao | B65H 1/08 271/186 |
| 7,708,271 | B2 * | 5/2010 | Major, Jr. | B65H 31/00 271/208 |
| 8,857,814 | B2 * | 10/2014 | Sugitani | B65H 31/00 271/208 |
| 8,998,197 | B2 * | 4/2015 | Murashima | G03G 15/6552 271/207 |
| 10,040,661 | B2 * | 8/2018 | Yoshida | B65H 31/20 |
| 10,185,273 | B2 * | 1/2019 | Adaniya | B65H 5/36 |
| 10,308,457 | B2 * | 6/2019 | Fomin | B65H 7/02 |

FOREIGN PATENT DOCUMENTS

| | | | |
|---|---|---|---|
| JP | 10226449 A | * | 8/1998 |
| JP | 2000-159414 A | | 6/2000 |

* cited by examiner

*Primary Examiner* — Jeremy R Severson
(74) *Attorney, Agent, or Firm* — Venable LLP

(57) ABSTRACT

A sheet discharging apparatus includes a discharge portion discharging a sheet in a discharge direction; a sheet supporting portion including a support surface which supports a lower surface of the sheet discharged from the discharge portion; and a conductive portion which is electrically conductive and connected to a ground potential. The conductive portion is provided at the support surface.

15 Claims, 8 Drawing Sheets

SHEET DISCHARGING APPARATUS AND IMAGE READING APPARATUS

BACKGROUND OF THE INVENTION

Field of the Invention

The present invention relates to a sheet discharging apparatus discharging a sheet and an image reading apparatus including the sheet discharging apparatus.

Description of the Related Art

Generally, in image forming apparatuses such as a copying machine and a facsimile machine, an image forming apparatus is known that includes a finisher connected to an image forming apparatus body, and discharging a sheet on which an image is formed in the image forming apparatus body. Conventionally, the finisher including a sample tray has been proposed. The sample tray is inclined such that the downstream in a sheet conveying direction becomes higher and the upstream with respect to the sheet conveying direction becomes lower. The trailing edge of a sheet discharged to the sample tray is received by a side part of a finisher body (see U.S. Pat. No. 6,505,829). Additionally, this finisher includes an earth (or ground) piece at the side part of the finisher body. The earth piece abuts the trailing edge of the discharged sheet, and performs static elimination of the static electricity of the sheet charged while being conveyed within the finisher. In this manner, the stacking failure of sheets due to floating of the sheets that is caused by repulsion between the sheets due to static electricity is prevented.

However, in a sheet processing apparatus described in U.S. Pat. No. 6,505,829, there was a possibility that the trailing edge of the discharged sheet did not reach the side part of the finisher body, and the sheet did not abut the earth piece in the case where the inclination of the sample tray was shallow due to the limitations of a body size, etc. Therefore, there has been a problem that the stacking failure of sheets occurs since a stable static elimination effect on the sheets discharged to the sample tray is not obtained.

SUMMARY OF THE INVENTION

Thus, the present invention provides a sheet discharging apparatus that exhibits a stable static elimination effect, and that can reduce the stacking failure of sheets, and provides an image reading apparatus including this sheet discharging apparatus.

A sheet discharging apparatus according to one example of the present invention, includes:

a discharge portion discharging a sheet in a discharge direction;

a sheet supporting portion including a support surface which supports a lower surface of the sheet discharged from the discharge portion; and a conductive portion which is electrically conductive and connected to a ground potential, wherein the conductive portion is provided at the support surface.

Further features of the present invention will become apparent from the following description of exemplary embodiments with reference to the attached drawings.

DESCRIPTION OF THE EMBODIMENTS

First Embodiment

[General Configuration]

Figure 1:
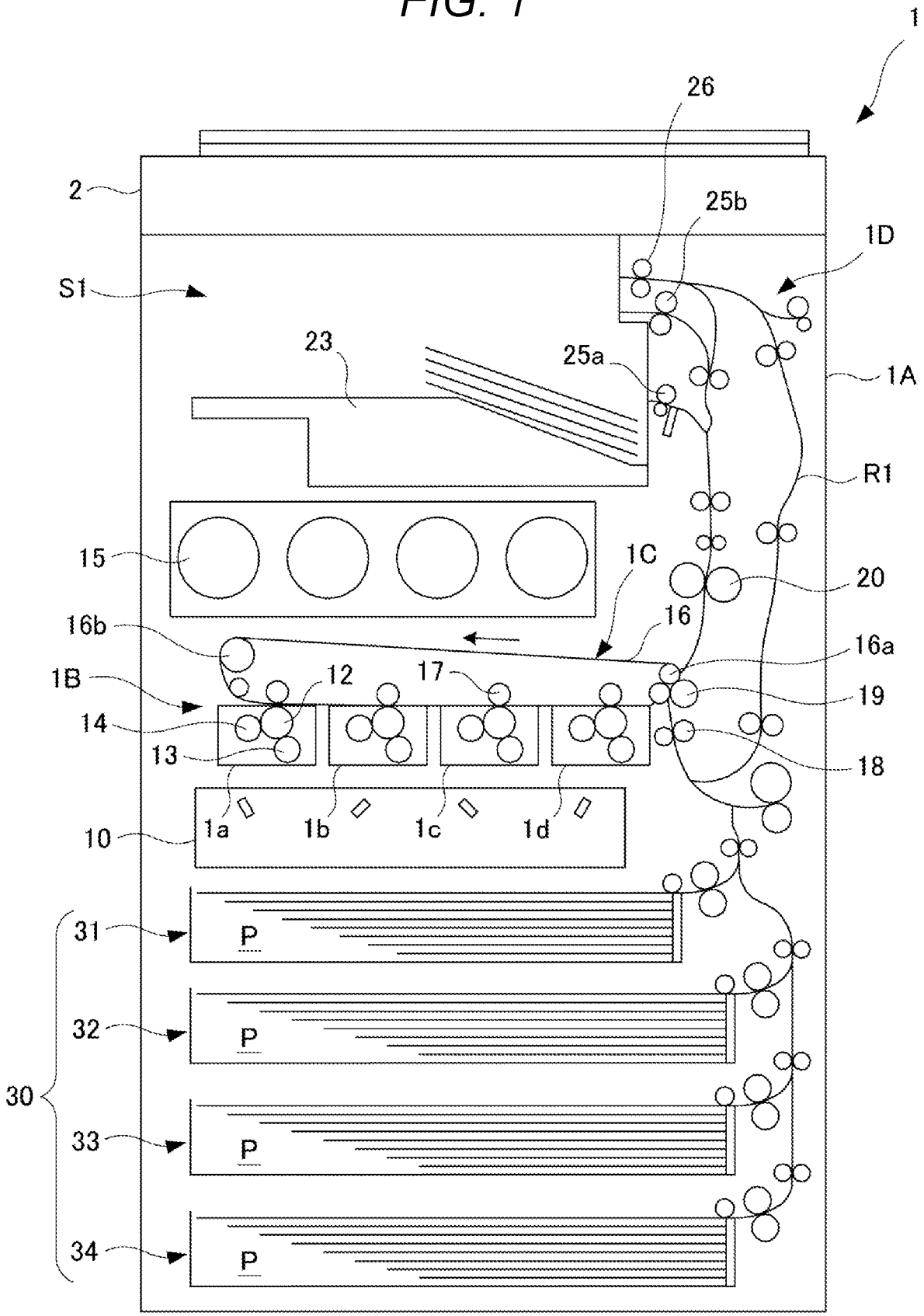
FIG. 1 is a general schematic diagram illustrating a printer according to a first embodiment.
Figure 2:
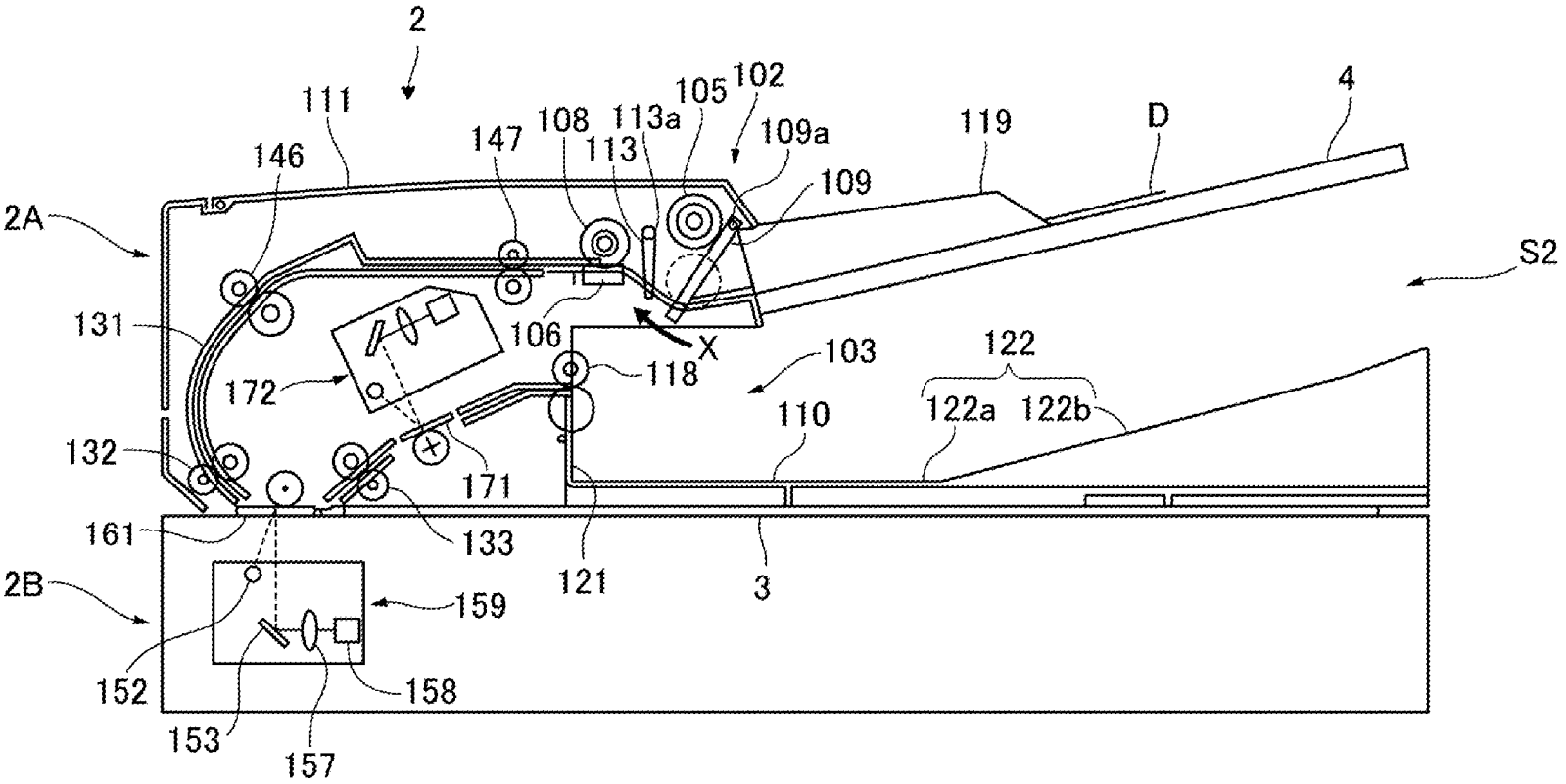
FIG. 2 is a schematic diagram illustrating an image reading apparatus.

First, a first embodiment according to the present invention will be described. A printer 1 as an image forming apparatus according to the first embodiment is an electrophotography type laser beam printer. As illustrated in FIG. 1 and FIG. 2, the printer 1 includes an image forming apparatus body 1A and an image reading apparatus 2. The image reading apparatus 2 arranged above the image forming apparatus body 1A includes an ADF 2A and a reader portion 2B serving as a reading portion as described below in detail, and optically scans a document D and reads picture information. The document D is a sheet, for example, a paper such as a form and an envelope, a plastic film such as a sheet for an overhead projector (OHP), and cloth, and includes a sheet on which an image is formed, and a sheet on which an image is not formed. The picture information changed into the electrical signal by image reading apparatus 2 is transmitted to the control unit (not shown) provided in image forming apparatus body 1A.

The printer 1 includes, inside of the image forming apparatus body 1A, an image forming unit 1B that forms an image on a sheet P, which is a recording medium on which the image is not formed, and a fixing portion 20 that fixes the image to the sheet P, etc. A sheet discharging tray 23 is provided in a sheet discharging space S1 formed between the image reading apparatus 2 and the image forming apparatus body 1A. Additionally, a sheet feeding portion 30 that feeds the sheet P to the image forming unit 1B is provided in the image forming apparatus body 1A. The sheet feeding portion 30 includes one or more (four in this embodiment) sheet feeders 31, 32, 33 and 34 arranged at the lower part of the image forming apparatus body 1A, and a manual feeder (not shown).

The image forming unit 1B has a so-called four-drum full-color configuration that includes a laser scanner 10, four process cartridges 1*a*, 1*b*, 1*c* and 1*d*, and an intermediate transfer unit 1C. These cartridges form toner images of yellow, magenta, cyan and black, respectively. Each of the process cartridges 1*a*, 1*b*, 1*c* and 1*d* includes a photosensitive drum 12, a charging device 13, a developing device 14, and a cleaner (not shown). Further, a toner cartridge 15 housing the toners of respective colors is removably attached to the image forming apparatus body 1A. The toner cartridge 15 is attached above the image forming unit 1B.

The intermediate transfer unit 1C includes an intermediate transfer belt 16 wrapped around a driving roller 16*a* and a tension roller 16*b*, etc., and is arranged above the four process cartridges 1*a*, 1*b*, 1*c* and 1*d*. The intermediate transfer belt 16 is rotated counterclockwise in FIG. 1 by the driving roller 16*a* driven by a driving unit (not shown) with the intermediate transfer belt 16 abutting the photosensitive drum 12 of each of the cartridges 1*a*, 1*b*, 1*c* and 1*d*. The intermediate transfer unit 1C includes four primary transfer rollers 17 abutting the inner periphery of the intermediate transfer belt 16 at the positions facing the respective photosensitive drum drums 12. Additionally, a secondary transfer roller 19 abutting the outer periphery of the intermediate transfer belt 16 is provided at the position facing the driving roller 16*a*.

In each of the above-mentioned process cartridges 1*a*, 1*b*, 1*c* and 1*d*, the toner image of each color charged to a negative polarity is formed by supplying a toner from the developing device 14 after an electrostatic latent image is drawn on the surface of photosensitive drum 12 drawn by the laser scanner 10. Further, the surface of each photosensitive drum 12 is charged in advance by the charging device 13 before laser is irradiated on the photosensitive drum 12 by the laser scanner 10. A full-color toner image is formed on the intermediate transfer belt 16 by performing the multiple transfer (primary transfer) of these toner images to the intermediate transfer belt 16 by applying a transfer bias voltage of positive polarity to the primary transfer rollers 17.

In parallel to such a formation process of the toner image, the sheet P fed from the sheet feeding portion 30 is conveyed toward a registration roller pair 18, and the skew is corrected by the registration roller pair 18. The registration roller pair 18 conveys the sheet P to a secondary transfer portion formed between the intermediate transfer belt 16 and the secondary transfer roller 19 according to the transfer timing of the full-color toner image formed on the intermediate transfer belt 16. The toner image carried by the intermediate transfer belt 16 is secondarily transferred to the sheet P by applying the transfer bias voltage of positive polarity to the secondary transfer roller 19.

When the sheet P on which the toner image is transferred is heated and pressurized in the fixing portion 20, the toner image is fixed to the sheet P as a color image. The sheet P on which the image was fixed is discharged to a sheet discharging tray 23 by sheet discharge roller pairs 25*a* and 25*b*, and is stacked. Further, in the case of forming an image on both surfaces of the sheet P, the sheet P having passed the fixing portion 20 is switched back by a reversing roller pair 26 that is provided in a reversed conveying portion 1D, and can perform forward rotation/reverse rotation. Then, when the sheet P is conveyed again to the image forming unit 1B via a re-conveying passage R1, an image is formed on the rear surface of the sheet P, the sheet P is discharged to the sheet discharging tray 23, and double-side printing is completed.

[Image Reading Apparatus]

As illustrated in FIG. 2, the image reading apparatus 2 includes a reader portion 2B that reads the image of the document D, and an ADF (Auto Document Feeder) 2A that can convey the document D to the reader portion 2B. The ADF 2A is supported by a hinge mechanism centering on an axis (not shown) that is disposed in the back side and extends in the left and right direction in FIG. 2, such that the ADF 2A can be opened and closed with respect to the reader portion 2B. By opening the ADF 2A, a document can be placed on a document glass plate 3 described later.

The reader portion 2B includes an optical box 159 as a reading unit reading the image of the document D, a platen glass 161, and the document glass plate 3 arranged along with the platen glass 161 on the upper surface of the reader portion 2B. The optical box 159 includes a lamp 152 irradiating the document D, and a mirror 153 guiding the reflected light from the document D. Additionally, the optical box 159 includes a lens 157 focusing the reflected light guided by the mirror 153, and a charge-coupled device 158 (hereinafter referred to as the CCD) that performs photoelectric conversion of the focused reflected light, and outputs the light as image information.

The optical box 159 is connected to a wire (not shown), and can perform reciprocating movement parallel to the document glass plate 3 by the driving of a motor (not shown). The optical box 159 performs the reciprocating movement between a reading position illustrated in FIG. 2 below the platen glass 161 and a scanning position below the document glass plate 3. Further, the position of the optical box 159 can be recognized by a position sensor (not shown) and the number of rotation pulses of the motor. Additionally, it is called a document flow reading to stop the optical box 159 at the reading position, and to read the document D moving on the platen glass 161. It is called fixed reading to place the document D on the document glass plate 3, and to read the document D while moving the optical box 159 from the reading position to the scanning position.

The ADF 2A includes a document feeder 102, a registration roller pair 146, conveyance guide 131, and a first lead roller pair 132. Additionally, the ADF 2A includes a second lead roller pair 133, a rear surface platen glass 171, a back side optical box 172 as a reading unit, and a document discharge apparatus 103 as a sheet discharging apparatus. The details of the ADF 2A are described later.

Next, the operation at the time of reading an image by the image reading apparatus 2 is described by taking as an example the case where the image is read by the document flow reading. When a control unit (not shown) receives an image reading signal of the document flow reading, the document D stacked on a document tray 4 is fed by the document feeder 102 described later. The positions of the end portions of the document D in a width direction orthogonal to the moving direction of the optical box 159 are regulated by a pair of width direction regulation plates 119. The skew of the document D is corrected by the registration roller pair 146, and the conveying direction of the document D is changed by the conveyance guide 131 that is curved, and the document D is conveyed toward the platen glass 161 by the first lead roller pair 132.

On this occasion, the optical box 159 is located in the reading position, which is the position below the platen glass 161 as illustrated in FIG. 2. The optical box 159 irradiates light by the lamp 152 toward the document D being conveyed on the platen glass 161, and the CCD 158 reads the reflected light from the document D via the mirror 153 and the lens 157. The CCD 158 performs photoelectric conversion of this reflected light, and outputs the light to the control unit as an electric image signal. Further, in this embodiment, the information of the document D is read by the CCD 158. However, other systems, such as a CIS and a CMOS, may be adopted as a sensor for detecting images.

After the image on the front surface of the document D is read by the optical box 159, the document D is conveyed by the second lead roller pair 133 toward the rear surface platen glass 171. As for the document D conveyed on the rear surface platen glass 171, an image on the rear surface is read by the back side optical box 172 as in the front surface. Then, after the images on the front surface and the rear surface of the document D are read, the document D is discharged by the document discharge apparatus 103 to a document discharging tray 110 described later. The document discharging tray 110 is arranged under the document tray 4 in the vertical direction, and the discharged document D is placed on the document discharging tray 110.

Next, the details of the ADF 2A are described. The document feeder 102 includes the document tray 4, the width direction regulation plates 119, a document detection lever 109, a feed cover 111, a shutter 113, a pickup roller 105, a separation conveyance roller 108, separation pad 106, and a conveying roller pair 147.

The document tray 4 on which the document D is placed is downwardly inclined as it proceeds to the downstream where the document D is conveyed. Additionally, the document tray 4 includes a pair of the width direction regulation plates 119 sliding in the width direction. The width direction regulation plates 119 can slide in the width direction of the document such that the interval distance between the width direction regulation plates 119 can be adjusted within the limits of the size of the document that can be placed on document tray 4, i.e., the size of the document that can be read by the image reading apparatus 2. The width direction regulation plates 119 can control the movement of the document D in the width direction by being slid according to the width of the document D placed on the document tray 4.

The document detection lever 109 is arranged downstream of the document tray 4 in the conveying direction of the document D. The document detection lever 109 is rotatably supported about a shaft 109*a*. Additionally, the document feeder 102 includes a document sensor (not shown) formed by a photo interrupter. In the state where the document D is not placed on the document tray 4, the document sensor is maintained in a shaded state where the document sensor is shaded by the document detection lever 109. When the document D is placed on the document tray 4, the document detection lever 109 is pressed by the document D, and the document detection lever 109 is rotated about the shaft 109*a* in the direction of an arrow X in FIG. 2. In this manner, the document sensor becomes a translucent state where the light of the document sensor is translucent, and detects that the document D is placed on the document tray 4. Then, when a transition is made to the state where the document D is not placed on the document tray 4, the document detection lever 109 is rotated in the direction opposite to the arrow X direction with its own weight. In this manner, the document sensor detects that all documents have been fed based on the transition from the translucent state to the shaded state.

A shutter 113 and a pickup roller 105 that is supported by a support arm (not shown) such that the pickup roller 105 can go up and down are arranged in the downstream of the document detection lever 109 in the conveying direction of the document D. The shutter 113 is rotatably supported about a rotation shaft 113*a*. When the pickup roller 105 is located at the standby position indicated by a continuous line in FIG. 2, the shutter 113 dams the document D by being held by a stopper (not shown) at a damming position illustrated in FIG. 2. Additionally, the stopper releases the holding of the shutter 113 when the pickup roller 105 moves downward from the standby position to a feed position indicated by a broken line in FIG. 2. Then, in the process of movement of the pickup roller 105 from the standby position to the feed position, the shutter 113 is pressed by a protruding portion formed in the support arm to be rotated to an evacuation position evacuating from the conveying path of the document D. Therefore, the shutter 113 is configured such that the shutter 113 will not resist the feeding of the document D when the pickup roller 105 is located at the feed position at which the pickup roller 105 abuts the document D.

Next, the positional relationship between the pickup roller 105 and the shutter 113 is described. The pickup roller 105 is standing by at the standby position close to the feed cover 111, such that the pickup roller 105 does not disturb the document placement when a user places the document D on the document tray 4. When the document D is placed, the tip of the document D passes under the pickup roller 105, pushes away the document detection lever 109 upward, and is held at the position at which the tip is made to abut the shutter 113.

When the feeding of the document D is started, the pickup roller 105 descends to the feed position, and abuts the top surface of the document D. On this occasion, the shutter 113 is located at the evacuation position, and releases the damming of the document D. Then, by the rotation of the pickup roller 105, the document D passes the shutter 113, and is conveyed toward the separation conveyance roller 108 and the separation pad 106. The separation pad 106 is arranged to face the separation conveyance roller 108, and is pressed against the separation conveyance roller 108. The separation pad 106 and the separation conveyance roller 108 are configured such that, when a plurality of documents D are simultaneously supplied by the pickup roller 105, the supplied documents D are separated by the separation pad 106 and the separation conveyance roller 108, and one document is fed at a time.

Each one of the documents D separated by the separation pad 106 and the separation conveyance roller 108 is conveyed by the conveying roller pair 147, and is conveyed along the conveyance guide 131 forming the conveying path of the document D while the skew is corrected by the registration roller pair 146. The document D is conveyed by the first lead roller pair 132 toward the platen glass 161, an image on the rear surface is read by the back side optical box 172, and thereafter, the document D is conveyed to the document discharge apparatus 103 by the second lead roller pair 133.

Figure 3:
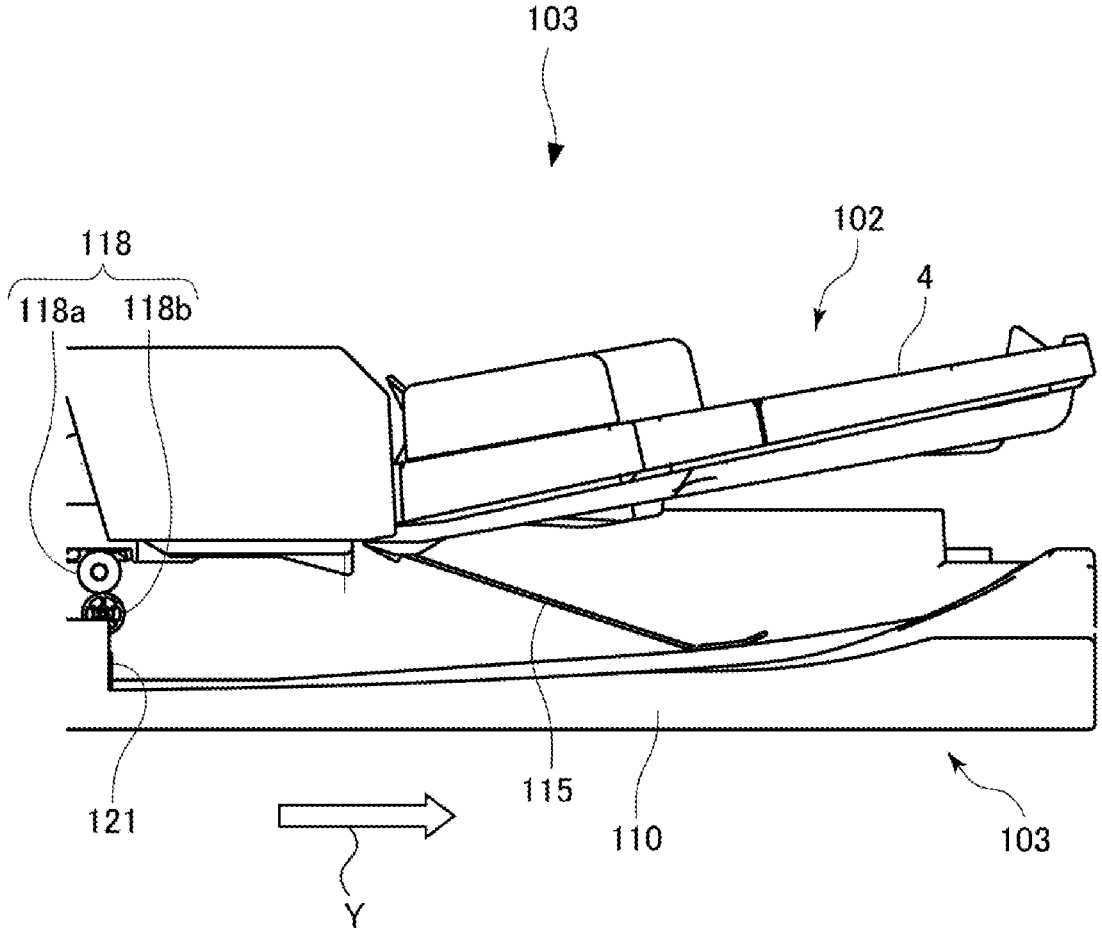
FIG. 3 is a side view illustrating an ADF.

As illustrated in FIG. 3, a document pressing member 115 is provided under the document tray 4. The document pressing member 115 extends to incline downward toward the downstream of a document discharge direction Y by the document discharge apparatus 103. The document pressing member 115 is rotatably supported by the document tray 4, and is pressed against the document discharging tray 110 described later by a spring (not shown). The document pressing member 115 abuts the discharged document D, and when the document D is discharged, serves as a resistance with a frictional force between the document pressing member 115 and the document D, and when a plurality of documents are discharged, reduces the amount of gap between the documents in the document discharge direction Y (hereinafter referred to as the matching amount). Additionally, the document pressing member 115 is pushed and rotated upward by the discharged document D. In this manner, it is prevented that the resistance at the time of discharging the document D becomes excessive.

[Details of Document Discharge Apparatus]

Figure 4:
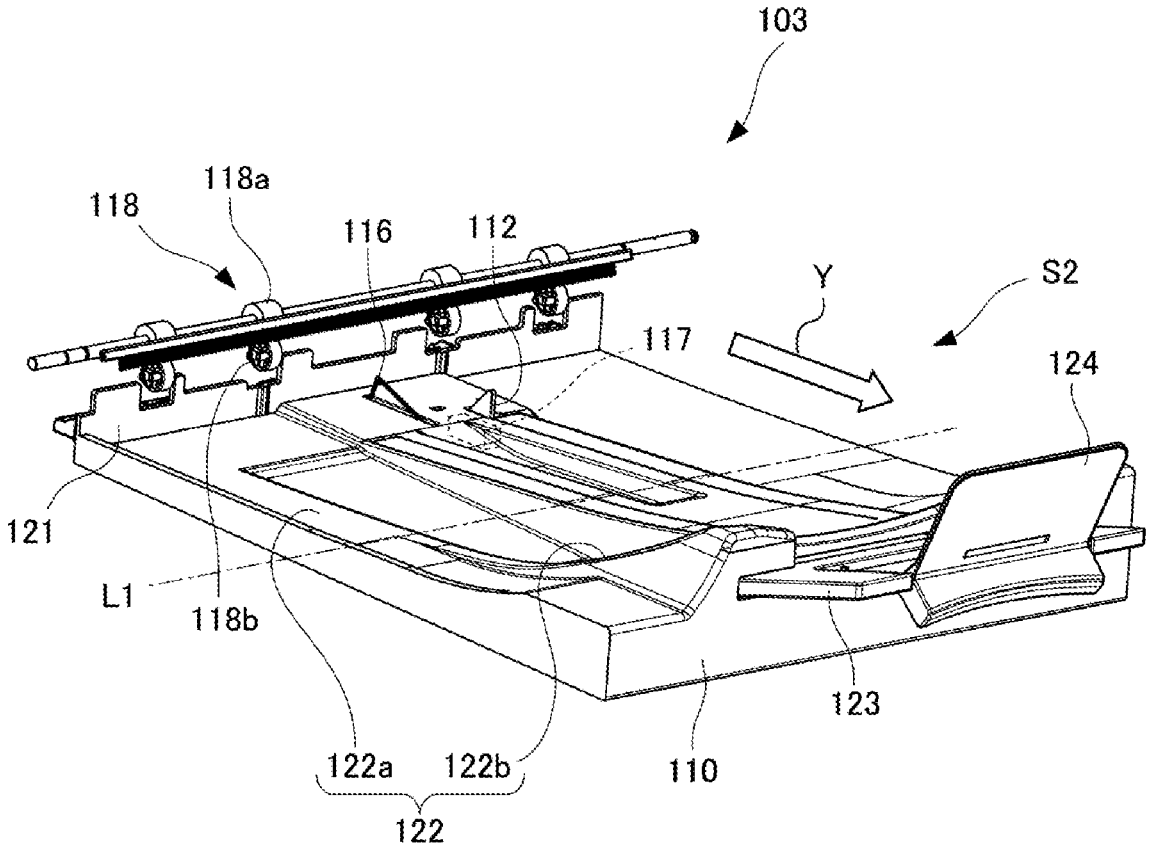
FIG. 4 is a perspective view illustrating a sheet discharging apparatus.
Figure 5:
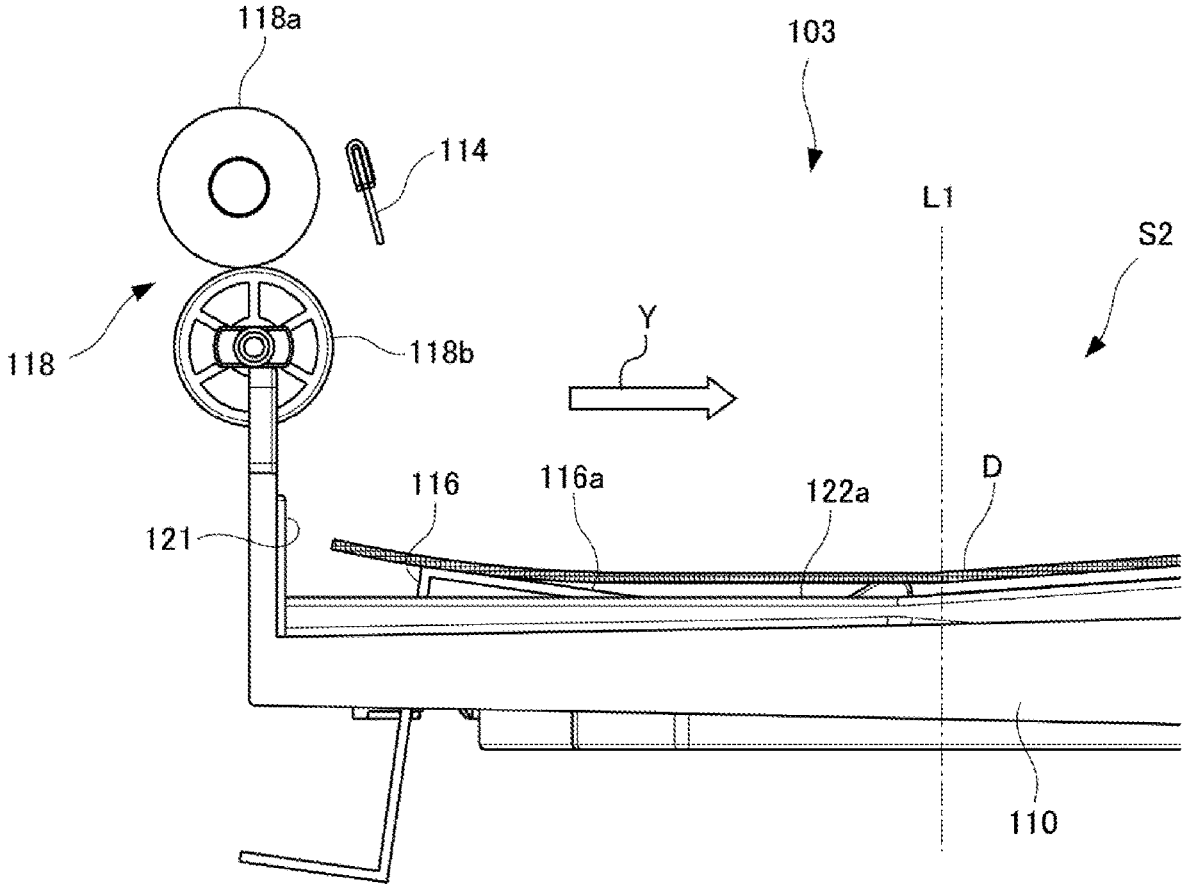
FIG. 5 is a side view illustrating a sheet discharging apparatus.

Hereinafter, referring to FIG. 4 and FIG. 5, the details of the document discharge apparatus 103 are described. As illustrated in FIG. 4 and FIG. 5, the document discharge apparatus 103 includes a plurality of document discharge roller pairs 118, a static eliminating needle 114, an upstream end wall 121 arranged near the document discharge roller pairs 118, and the document discharging tray 110 as a sheet supporting portion on which the discharged document is stacked.

The document D conveyed by the second lead roller pair 133 (see FIG. 2) is conveyed to the document discharge roller pairs 118 as discharge portions. The document discharge roller pair 118 includes a discharge roller 118*a* that is driven, and a discharge rotation roller 118*b* that is arranged to face the discharge roller 118*a*, and follows and rotates according to the discharge roller 118*a* by being pressed against the discharge roller 118*a*. The document D is conveyed by the discharge roller 118*a* and a nip part of the discharge rotation roller 118*b*, and is discharged to a document discharge space S2 formed between the document tray 4 and the document discharging tray 110 as illustrated in FIG. 2.

As illustrated in FIG. 4, the document discharging tray 110 is provided with extension trays 123 and 124, a discharge sensor flag 112, a discharge sensor 117 as a detector, and an earth member (conductive member) 116 as a conductive portion. Additionally, the top surface of the document discharging tray 110 forms a support surface 122 that supports the lower surface of the document D.

The extension trays 123 and 124 are arranged in the downstream end of the document discharging tray 110 in the document discharge direction Y, and are configured to be slidable with respect to the document discharging tray 110 along the support surface 122. The extension trays 123 and 124 will be in the state where the extension trays 123 and 124 can support the discharged document D by being slid in the document discharge direction Y, even when the length of the discharged document D in the conveying direction is longer than the document discharging tray 110. Additionally, when the length of the discharged document D in the conveying direction is smaller than the document discharging tray 110, the extension trays 123 and 124 are slid in the direction opposite to the document discharge direction Y, and can be stored in the document discharging tray 110. In this manner, the image reading apparatus 2 enables the suppression of the length of the image reading apparatus 2 in the document discharge direction Y, while enabling the reading of a document having a long length in the conveying direction.

The support surface 122 includes an inclined surface 122*b* as the first surface that inclines upward toward the downstream of the document discharge direction Y. Additionally, the support surface 122 includes a parallel surface 122*a* as the second surface that is substantially parallel to the document glass plate 3, and that has a smaller angle than the inclined surface 122*b* with respect to a horizontal plane. Further, in this embodiment, the parallel surface 122*a* and the document glass plate 3 are provided parallel to a horizontal direction. The parallel surface 122*a* is arranged upstream of the inclined surface 122*b* in the document discharge direction Y, and the upstream end is located under the document discharge roller pairs 118, and the downstream end is connected to the inclined surface 122*b* with a gentle curve. The upstream end wall 121 is provided upstream of the support surface 122 in the document discharge direction Y, and restricts the trailing edge of the discharged document D. The upstream end wall 121 is formed to rise upward toward the document discharge roller pairs 118 from the upstream end of the parallel surface 122*a* in the document discharge direction Y.

As illustrated in FIG. 2, the document D discharged to the document discharge space S2 by the document discharge roller pairs 118 is moved in the document discharge direction Y along the parallel surface 122*a*, and is moved upward along the inclined surface 122*b* after abutting the inclined surface 122*b*. Thereafter, the document D slides down along the inclined surface 122*b* in the direction opposite to the document discharge direction Y, and approaches or abuts the upstream end wall 121 and stops. In this manner, when the upstream end wall 121 abuts the trailing edge of the document D discharged onto the document discharging tray 110, the upstream end wall 121 restricts the movement of the document D in the direction opposite to the document discharge direction Y, and also reduces the matching amount in the case where a plurality of documents are discharged. Further, in the following description, the trailing edge of the document D refers to the upstream edge of the document D in the document discharge direction Y, and the leading edge of the document D refers to the downstream edge of the document D in the document discharge direction Y.

Additionally, when the angle of the inclined surface 122*b* with respect to the horizontal plane is small, it becomes difficult for the discharged document D to reach the upstream end wall 121 and the matching amount increases. Thus, it is desirable that the angle of the inclined surface 122*b* with respect to the horizontal plane is sufficiently large. Additionally, when the length of the document discharge space S2 in the up-and-down direction is small, in the case where the discharged document is curved upward, discharge failure tends to occur. For example, the document D is caught in the lower part of the document tray 4. Therefore, it is desirable for the upstream end of the inclined surface 122*b* to be arranged sufficiently distant from the document tray 4 in the up-and-down direction. However, in recent years, it is required that the size of the ADF 2A is reduced in the up-and-down direction, and the angle formed between the horizontal plane and the inclined surface 122*b* is set to be as small as possible, while considering the influence on the matching amount, the influence on the discharge failure of a document, etc.

The discharge sensor flag 112 is supported by the document discharging tray 110 so as to be rotatable about an axis extending in the width direction, and is urged toward a protruding position protruding from the parallel surface 122*a* by a spring (not shown). Additionally, the discharge sensor flag 112 is arranged near the center of the parallel surface 122*a* in the width direction. Specifically, the discharge sensor flag 112 is arranged to protrude from the parallel surface 122*a* between the far end and the close end of the document D when located at the protruding position, in the state where the document D having the minimum size that can be read by the image reading apparatus 2 is located at the center in the width direction. In this manner, the width direction position of the discharge sensor flag 112 is set to the position at which the discharge sensor flag 112 stably abuts the lower surface of the document D in the state where the document D rests, even when the document D having the minimum size that can be read by the image reading apparatus 2, i.e., the document D having the minimum size that can be supported by the document discharging tray 110, is discharged. Note that, in the following description, a document having the minimum size that can be supported by the document discharging tray 110 is simply called a minimum size document.

Additionally, when located at the protruding position, the discharge sensor flag 112 is arranged to protrude from the parallel surface 122*a* at a position distant from the upstream end wall 121 in the downstream side. In this manner, the position of the discharge sensor flag 112 in the document discharge direction Y is set to the position at which the discharge sensor flag 112 stably abuts the lower surface of the document D in the state where the document D rests, even when the discharged document D does not reach the upstream end wall 121. Further, the discharge sensor flag 112 is arranged upstream of the middle L1 of the support surface 122 in the document discharge direction Y. Specifically, the discharge sensor flag 112 is arranged to protrude from the parallel surface 122*a* in the upstream of the leading edge of the document D in the document discharge direction Y when located at the protruding position, in the state where the minimum size document D is discharged, abuts and rests on the upstream end wall 121. In this manner, the position of the discharge sensor flag 112 in the document discharge direction Y is set to the position at which the discharge sensor flag 112 stably abuts the lower surface of the document D in the state where the document D rests, even when the minimum size document D is discharged. When the document D is discharged to the discharge space S2, the discharge sensor flag 112 abuts the lower surface of the document D, is rotated downward by the weight of the document D, and is moved to a retracted position as a lower position at which the protruding amount from the parallel surface 122*a* is smaller than that at the protruding position.

The discharge sensor 117 is formed by a photo interrupter, and is maintained in the shaded state where the light is shaded by the discharge sensor flag 112 in the state where the lower surface of the discharged document D is not abutting the discharge sensor flag 112. The discharge sensor 117 is pressed by the lower surface of the document D discharged to the discharge space S2, transitions to the translucent state where the light of the discharge sensor 117 is translucent based on the rotation of the discharge sensor flag 112, and outputs a detection signal detecting that the document D has been discharged to the discharge space S2. In this manner, the discharge sensor 117 is detecting whether or not a document that a user has not collected is on the document discharging tray 110. Additionally, the discharge sensor 117 also detects that all of the discharged documents have been collected from the document discharging tray 110 when the discharge sensor 117 transitions from the translucent state to the shaded state. Additionally, when the discharge sensor 117 has detected that an uncollected document is on the document discharging tray 110, an LED lamp (not shown) provided in the ADF 2A is lit, so as to report to the user that the uncollected document is on the document discharging tray 110.

Next, the static elimination of the document D is described. The surface of the document D is charged by sliding friction with the conveyance guide 131, various rollers, the separation pad 106, etc. that are forming the conveying path inside the ADF 2A. Especially, when a plurality of documents are continuously discharged in a low humidity environment, if a document discharged next overlaps with a document discharged previously and supported by the support surface 122, the repulsion occurs between the charged documents due to static electricity, and it becomes difficult for the document discharged next to fall. When discharging of the document is continued in such a state, discharge failure may occur. For example, the ends of the documents may abut to each other to cause conveyance jam, and the discharged document may be folded. Therefore, the image reading apparatus 2 of the present embodiment includes, as a static elimination unit of the discharged document D, the static eliminating needle 114 (see FIG. 5) and the earth member 116, which are each connected to the ground potential.

As illustrated in FIG. 5, the static eliminating needle 114 is arranged near the downstream of the document discharge roller pairs 118 in the document discharge space S2, and is formed by a plurality of thin metal wires arranged side by side in the width direction. The static eliminating needle 114 abuts the document D immediately after the document D is discharged from the document discharge roller pairs 118, and performs static elimination of a part of the electric charge on the surface of the document D. Although the static elimination of a part of the electric charge of the document D discharged from the document discharge roller pairs 118 is performed by the static eliminating needle 114, since the abutment surface between the document D and the static eliminating needle 114 is small and the abutment time is short, sufficient static elimination effect is not obtained in many cases. Therefore, the document discharge apparatus 103 in this embodiment is configured to perform the static elimination of the document D discharged from the document discharge roller pairs 118 by the static eliminating needle 114, and thereafter to perform the static elimination by the earth member 116 subsequently.

The earth member 116 is formed by a metallic wire, includes a guide surface 116*a* inclined upward toward the upstream of the document discharge direction Y with respect to the parallel surface 122*a*, and is urged toward a protruding position protruding from the parallel surface 122*a* by the elastic force of the earth member 116 itself. Additionally, the earth member 116 is arranged near the center of the parallel surface 122*a* in the width direction. Specifically, the earth member 116 is arranged to protrude from the parallel surface 122*a* between the far end and the close end of the document D when located at the protruding position, in the state where the minimum size document D is located at the center of the width direction. In this manner, the position of the earth member 116 in the width direction is set to the position at which the earth member 116 stably abuts the lower surface of the document D in the state where the document D rests, even when the minimum size document D is discharged.

Additionally, when located at the protruding position, the earth member 116 is arranged to protrude from the parallel surface 122*a* at the position distant from the upstream end wall 121 in the downstream side. In this manner, the position of the earth member 116 in the document discharge direction Y is set to the position at which the earth member 116 stably abuts the lower surface of the document D in the state where the document D rests, even when the discharged document D does not reach the upstream end wall 121. Further, the earth member 116 is arranged upstream of the middle L1 of the support surface 122 in the document discharge direction Y. Specifically, the earth member 116 is arranged to protrude from the parallel surface 122*a* in the upstream of the leading edge of the document D in the document discharge direction Y when located at the protruding position, in the state where the minimum size document D is discharged, abuts and rests on the upstream end wall 121. In this manner, the position of the earth member 116 in the document discharge direction Y is set to the position at which the earth member 116 stably abuts the lower surface of the document D in the state where the document D rests, even when the minimum size document D is discharged.

When the document D slides down along the inclined surface 122*b* (see FIG. 4), the earth member 116 guides the trailing edge of the document D gently upwards by the guide surface 116*a*, and the guide surface 116*a* is pressed down to be elastically deformed (move down) by the own weight of the document D. In this manner, the earth member 116 moves to a retracted position as a lower position at which the protrusion amount from the parallel surface 122*a* is smaller than that at the protruding position. In this way, the earth member 116 is configured to reduce the matching amount by passing the trailing edge of the document D to the upstream of the document discharge direction Y by the guide surface 116*a* smoothly and without sticking, and to stably abut the lower surface of the document D. In this manner, the earth member 116 performs the static elimination of a part of the electric charge on the front side of the document stacked on the document discharging tray 110.

Next, referring to FIG. 6A, FIG. 6B, FIG. 6C and FIG. 6D, the static elimination principle by the earth member 116 is described. FIG. 6A to FIG. 6D are schematic diagrams illustrating the time progress since a first document D1 is discharged from the document discharge roller pairs 118 until a second document D2 is supported by the document discharging tray 110.

Figure 6A:
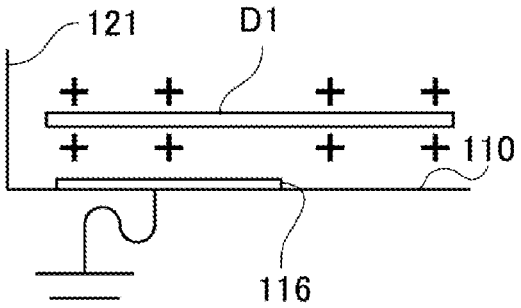
FIG. 6A is an explanatory diagram illustrating the static elimination principle in the state where the first sheet of a discharged document has not abutted an earth member yet.
Figure 6B:
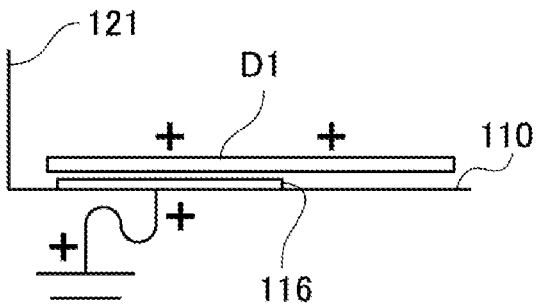
FIG. 6B is an explanatory diagram illustrating the static elimination principle in the state where the first sheet of the discharged document has abutted the earth member.
Figure 6C:
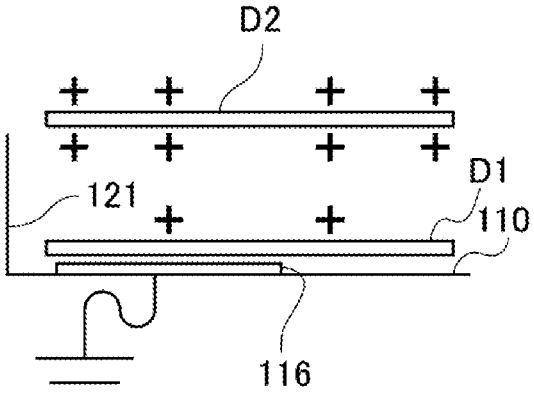
FIG. 6C is an explanatory diagram illustrating the static elimination principle in the state where the second sheet of the discharged document has not abutted the first sheet of document yet.
Figure 6D:
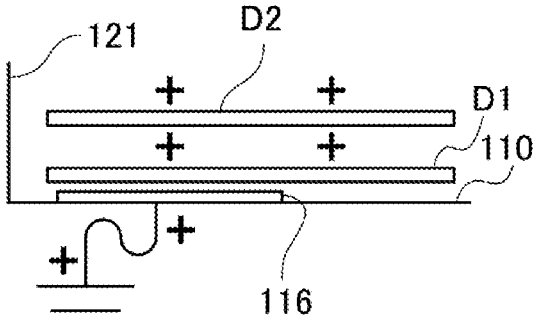
FIG. 6D is an explanatory diagram illustrating the static elimination principle in the state where the second sheet of the discharged document has abutted the second sheet of document.

As illustrated in FIG. 6A, the both surfaces of the first document D1 that is discharged from the document discharge roller pairs 118 (see FIG. 5), and has not abutted the earth member 116 yet are positively charged. Thereafter, as illustrated in FIG. 6B, when the lower surface of the first document D1 abuts the earth member 116, the static elimination of a part of the electric charge on the front surface of the first document D1 is performed. Next, as illustrated in FIG. 6C, the both surfaces of the second document D2 that is discharged from the document discharge roller pairs 118, and has not abutted the first document D1 yet are positively charged as in the first document D1. In this state, the static elimination of a part of the electric charge on the surface of the first document D1 located under the second document D2 is already performed. Thus, the repulsion between the second document D2 and the first document D1 is decreased compared to the repulsion before performing the static elimination. In this manner, the second document D2 falls quickly, and is stacked on the first document D. Thus, it is prevented that the second document D2 and the third and subsequent discharged documents abut to each other at their ends. Thereafter, as illustrated in FIG. 6D, when the first document D1 abuts the second document D2, the static elimination of a part of the electric charge on the surface of the second document D2 is performed through the surface of the first document D1, which is an insulator. In this manner, the static elimination of the documents D stacked on the document discharging tray 110 is sequentially performed.

As described above, in this embodiment, the lower surface of the firstly discharged document located at the bottom among the documents discharged to the discharge space S2 and stacked abuts the earth member 116, irrespective of whether or not the firstly discharged document has reached to the upstream end wall 121. Therefore, even when the discharged document has not reached the upstream end wall 121, the static elimination of the second and subsequent documents is performed by the earth member 116 through the front side of the document discharged first. Accordingly, a stable static elimination effect can be exhibited, and the stacking failure of documents can be reduced.

Additionally, in this embodiment, it is not necessarily required that the discharged document D reaches the upstream end wall 121. Thus, the angle of the inclined surface 122*b* with respect to the horizontal plane can be made small, and the size of the ADF 2A in the up-and-down direction can be reduced.

Further, in this embodiment, the earth member 116 is formed by metal wires, and is configured to be elastically deformed downward by the own weight of the document D. However, the configuration of the earth member 116 is not limited to this configuration. The earth member 116 may be formed such that at least a portion abutting the document D is formed with an electrically conductive material, and is moved downward by the own weight of the document D. For example, the earth member 116 may be molded with an electrically conductive synthetic resin, and may be supported by the document discharging tray 110 such that the earth member 116 can be rotated to the retracted position as the lower position by the own weight of the document D. Additionally, for example, the earth member 116 may be molded with a synthetic resin that is an insulator, a metal plate or the like may be arranged at the portion abutting the document D, and may be supported by the document discharging tray 110 such that the earth member 116 can be rotated to the retracted position as the lower position by the own weight of the document D. In such a case, the earth member 116 may be urged toward the protruding position by its own weight by arranging the center of gravity on the opposite side of the portion abutting the document D with respect to the rotation center, or may be urged toward the protruding position by a spring, etc.

According to the first embodiment, the stable static elimination effect can be exhibited, and the stacking failure of sheets can be reduced.

Second Embodiment

Next, a second embodiment in the present invention is described. As for the configurations similar to those in the first embodiment, the illustration will be omitted, or a description will be given by assigning the identical reference numerals to the figures.

Figure 7:
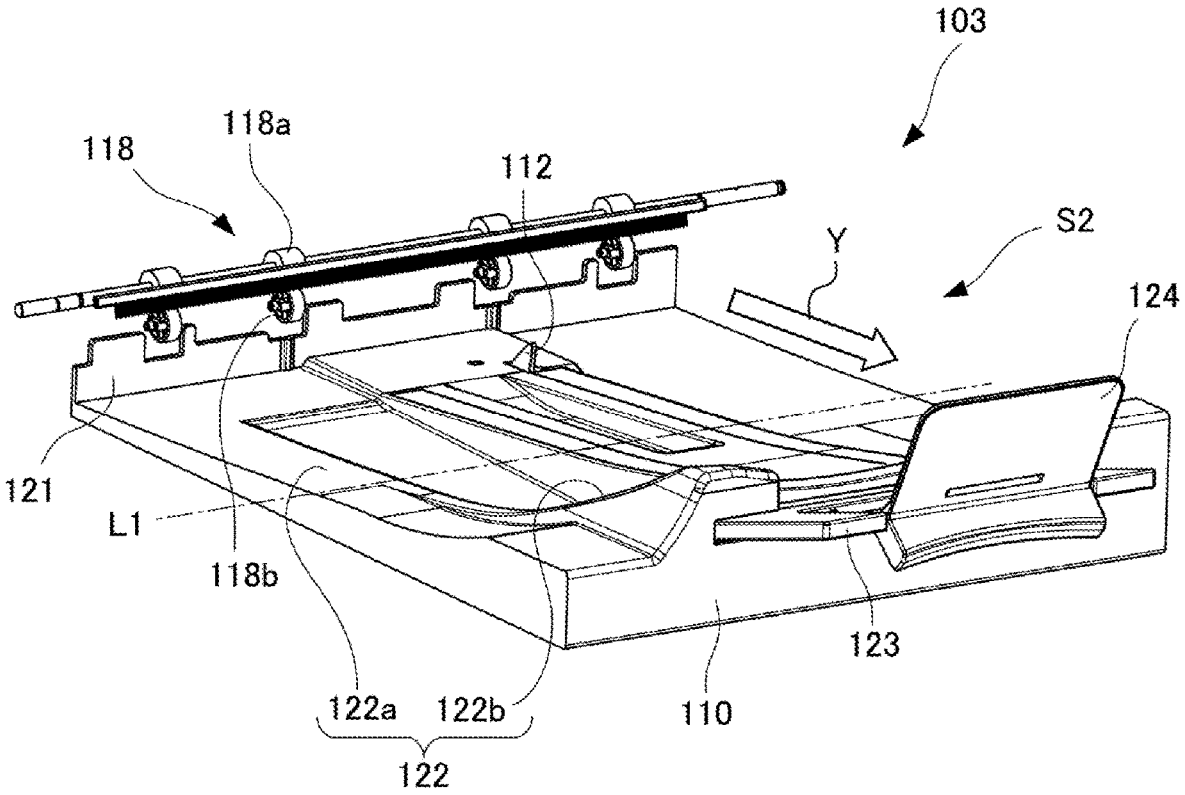
FIG. 7 is a perspective view illustrating a sheet discharging apparatus according to a second embodiment.

As illustrated in FIG. 7, the discharge sensor flag 112 as the conductive portion is formed with an electrically conductive material, for example, an electrically conductive synthetic resin, metal, etc. and is connected to the ground potential. The lower surface of the firstly discharged document located at the bottom among the documents discharged to the discharge space S2 and stacked abuts the sensor flag 112, irrespective of whether or not the firstly discharged document has reached the upstream end wall 121.

As described above, in this embodiment, even when the documents discharged to the discharge space S2 has not reached the upstream end wall 121, the static elimination of the second and subsequent documents is performed by the earth member 116 through the front side of the firstly discharged document. Thus, the stable static elimination effect can be exhibited, and the stacking failure of documents can be reduced. Additionally, the discharge sensor flag 112 also serves as an earth member. Thus, it is unnecessary to newly provide an earth member in order to perform the static elimination of the discharged document D, and the number of components can be reduced.

Further, the discharge sensor flag 112 may be formed to have a guide surface inclined upward toward the upstream of the document discharge direction Y with respect to the parallel surface 122*a*. In this case, the discharge sensor flag 112 may be configured such that, when the document D slides down along the inclined surface 122*b*, the trailing edge of the document D is gently guided upward by the guide surface, and the guide surface is pressed down and moved downward by the own weight of the document D. With such a configuration, the discharge sensor flag 112 can reduce the matching amount by passing the trailing edge of the document D to the upstream of the document discharge direction Y by the guide surface smoothly and without sticking, and can stably abut the lower surface of the document D.

According to the second embodiment, the stable static elimination effect can be exhibited, and the stacking failure of sheets can be reduced.

Third Embodiment

Next, a third embodiment in the present invention is described. As for the configurations similar to those in the first embodiment, the illustration will be omitted, or a description will be given by assigning the identical reference numerals to the figures.

Figure 8:
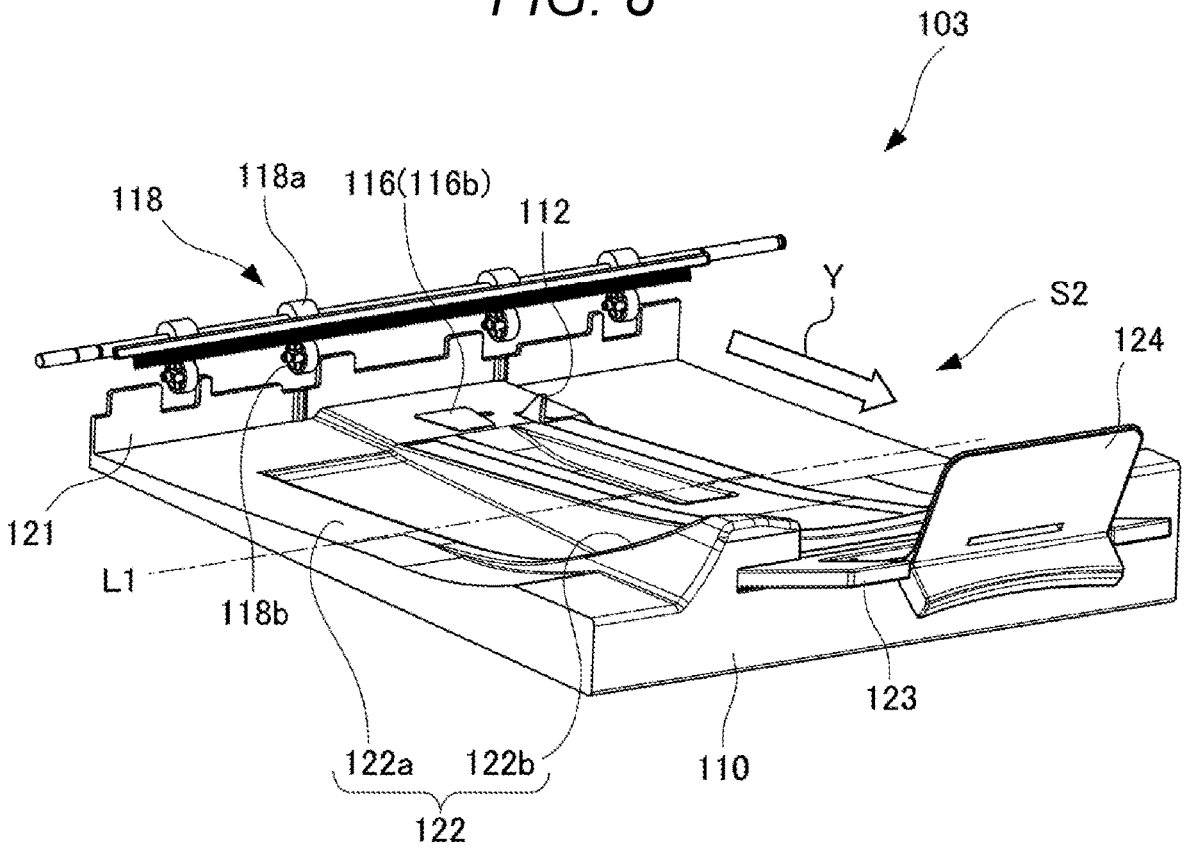
FIG. 8 is a perspective view illustrating a sheet discharging apparatus according to a third embodiment.

As illustrated in FIG. 8, the earth member 116 is formed to be a sheet shape along the parallel surface 122*a* of the support surface 122. The earth member 116 is a metal plate fixed to the parallel surface 122*a*, and is connected to the ground potential. The earth member 116 is arranged such that an upper surface 116*b* is flush with the parallel surface 122*a*, or slightly protrudes form the parallel surface 122*a*. Further, the upper surface 116*b* of the earth member 116 forms an abutment surface that can abut a sheet in the present embodiment.

Additionally, the earth member 116 is arranged near the center of the parallel surface 122*a* in the width direction. Specifically, the earth member 116 is arranged at the position at which the earth member 116 abuts the lower surface of the document D in the state where the minimum size document D is located at the center of the width direction. In this manner, the position of the earth member 116 in the width direction is set to the position at which the earth member 116 stably abuts the lower surface of the document D in the state where the document D rests, even when the minimum size document D is discharged. Further, the earth member 116 is arranged at the position at which the downstream end in the document discharge direction Y is distant from the upstream end wall 121 in the downstream side. In this manner, the position of the earth member 116 in the document discharge direction Y is set to the position at which the earth member 116 stably abuts the lower surface of the document D in the state where the document D rests, even when the discharged document D does not reach the upstream end wall 121. Further, the earth member 116 is arranged such that the upstream end in the document discharge direction Y is located upstream of the middle L1 of the support surface 122. Specifically, the earth member 116 is arranged such that the upstream end of the earth member 116 is located upstream of the leading edge of the document D in the document discharge direction Y, in the state where the minimum size document D is discharged, abuts and rests on the upstream end wall 121. In this manner, the position of the earth member 116 in the document discharge direction Y is set to the position at which the earth member 116 stably abuts the lower surface of the document D in the state where the document D rests, even when the minimum size document D is discharged.

As described above, in this embodiment, the earth member 116 is fixed such that the earth member 116 is flush with the parallel surface 122*a*, or slightly protrude from the parallel surface 122*a*. In this manner, the earth member 116 can reduce the matching amount by passing the trailing edge of the document D to the upstream of the document discharge direction Y smoothly and without sticking, and it becomes easy to set the abutment area abutting the document D. For example, it becomes easy to set the area of the upper surface 116*b* of the earth member 116 abutting the document D to be large when the static elimination effect is insufficient, and to set the area of the upper surface 116*b* to be small when the static elimination effect is excessive. Further, it is desirable that the area of the upper surface 116*b* is smaller than the area of one surface of the minimum size document. In this manner, it is possible to prevent the static elimination effect from becoming excessive, and to prevent the documents discharged and stacked from being attracted to each other such that it becomes difficult to separate the documents.

Further, in this embodiment, the earth member 116 is arranged at the position at which the earth member 116 abuts the lower surface of the document D in the state where the minimum size document D is located at the center of the width direction. Additionally, the downstream end of the earth member 116 is distant from the upstream end wall 121 in the downstream side of the document discharge direction Y, and the upstream end of the earth member 116 is arranged upstream of the leading edge of the minimum size document D that abuts and rests on the upstream end wall 121. However, the configuration of the earth member 116 is not limited to this configuration. The earth member 116 may be arranged such that the far end is closer to the center than the far end of the document D, and the close end is closer to the center than the close end of the document D in the state where the minimum size document D is located at the center of the width direction. Additionally, the earth member 116 may be arranged such that, for example, the downstream end of the earth member 116 in the document discharge direction Y is upstream of the leading edge of the document D in the document discharge direction Y in the state where the minimum size document D is discharged, abuts and rests on the upstream end wall 121. With such a configuration, even when the minimum size document D is discharged, the entire upper surface 116*b* of the earth member 116 stably abuts the lower surface of document D in the state where the document D rests. Thus, the stable static elimination effect can be exhibited. In addition, conversely, the earth member 116 may be arranged at the position at which, when a large size document is discharged, the entire upper surface 116*b* abuts the lower surface of the document, and when a small size document is discharged, a part of the upper surface 116*b* abuts the lower surface of the document. With such a configuration, the static elimination effect can be adjusted according to the size of the discharged document by changing the area in which the lower surface of the document abuts the upper surface 116*b* according to the size of the discharged document.

Further, in this embodiment, the earth member 116 is a metal plate formed into the sheet shape along the parallel surface 122*a* of the support surface 122. However, the configuration of the earth member 116 is not limited to this configuration. The earth member 116 may be formed into a sheet shape with an electrically conductive material. The earth member 116 may be formed into a sheet shape with an electrically conductive synthetic resin, or may be formed into a sheet shape with a metal cloth in which metallic threads are knit. Additionally, the support surface 122 may be formed with a synthetic resin, a portion where the discharged document can abut may be formed with an electrically conductive synthetic resin, the other portion may be formed with a synthetic resin that is an insulator, and these portions may be integrally formed. Additionally, the earth member 116 in the first embodiment may be formed by a sheet shaped metal plate.

According to the third embodiment, the stable static elimination effect can be exhibited, and the stacking failure of sheets can be reduced.

Other Embodiments

Further, in the first, second and third embodiments described above, the support surface 122 is configured to include the parallel surface 122*a* that is parallel to the horizontal direction, and the inclined surface 122*b* that is inclined upward toward the downstream of document discharge direction Y. However, the configuration of the support surface 122 is not limited to this configuration. The support surface 122 may be able to support the lower surface of the discharged document D. For example, each of the parallel surface 122*a* and the inclined surface 122*b* may be formed by a flat surface, and the parallel surface 122*a* and the inclined surface 122*b* may be connected to each other by a gently curved surface, or each of the parallel surface 122*a* and the inclined surface 122*b* may be formed by a curved surface. When each is formed by a curved surface, the angle with respect to the horizontal plane refers to the angle between a virtual surface in which the parallel surface 122*a* contacts the inclined surface 122*b* in a predetermined part and the horizontal plane. Additionally, for example, the parallel surface 122*a* and the inclined surface 122*b* are not limited to those having a uniform surface in the width direction. For example, a plurality of ribs having a semicircular cross section may be formed in the upper part of the document discharging tray 110 along the document discharge direction Y, such that the upper surfaces of the ribs to which the document D can abut form the parallel surface 122*a* and the inclined surface 122*b*. Additionally, for example, the support surface 122 may be configured to include the parallel surface 122*a* as the second surface that is inclined upward toward to the downstream of document discharge direction Y. Additionally, for example, the support surface 122 may be configured to be inclined upward toward the downstream of the support surface 122 from the upstream end wall 121.

Additionally, in the first, second and third embodiments described above, the document pressing member 115 is configured to be pressed against the document discharging tray 110. However, the configuration of the document pressing member 115 is not limited to this configuration. The document pressing member 115 may extend downward from the lower part of the document tray 4, and abut the discharged document D, such that a frictional force is generated between the document pressing member 115 and the document D. For example, the tip of the document pressing member 115 may be arranged at the position that is distant from the document discharging tray 110 and abuts the discharged document D, or may be configured to be elastically deformed when abutting the document D. Additionally, when the document pressing member 115 is configured to be pressed by the discharged document D so as to be rotated upward, an urging unit urging the document pressing member 115 to be rotated downward may be a spring (not shown), or may be the own weight of the document pressing member 115. Additionally, the document pressing member 115 is configured to be rotatably supported by the document tray 4. However, the configuration of the document pressing member 115 is not limited to this configuration. For example, the document pressing member 115 may be rotatably supported by a frame of the ADF 2A that covers each of the rollers, the conveyance guide 131, etc., or may be rotatably supported by other components forming the ADF 2A.

Additionally, in the first, second and third embodiments described above, the discharge portion discharging a sheet in the discharge direction is configured by the document discharge roller pairs 118. However, the configuration of the discharge portion is not limited to this configuration. The discharge portion may be a part that discharges a sheet to the outside of an apparatus, and maybe, for example, a belt pair, or a combination of a roller and a belt.

Additionally, in the first, second and third embodiments described above, the sheet supporting portion is configured by the document discharging tray 110. However, the configuration of the sheet supporting portion is not limited to this configuration. It is not necessary for the sheet supporting portion to be formed into a sheet shape or a box shape having a bottom. The sheet supporting portion may be formed to be able to stack and support sheets. For example, the sheet supporting portion may be formed into a basket shape that can support a sheet with wire, etc., or may be formed into a rail shape that can partially support a sheet.

Additionally, in the first, second and third embodiments described above, the document discharge apparatus 103 is described that discharges one document D at a time. However, the configuration of the document discharge apparatus 103 is not limited to this configuration. For example, the document discharge apparatus may be configured to discharge a plurality of documents in a bundle.

Additionally, in the first, second and third embodiments described above, the document discharge apparatus 103 as the sheet discharging apparatus that discharges the document D whose image was read by the image reading apparatus 2. However, the configuration of the document discharge apparatus 103 is not limited to this configuration. For example, the sheet discharging apparatus may be formed by a sheet discharge roller pair 25*a* discharging the sheet P on which an image is formed by the image forming unit 1B, and a sheet discharging tray 23 on which the sheet discharged by the sheet discharge roller pair 25*a* is stacked.

Additionally, in the first, second and third embodiments described above, the image reading apparatus 2 is described that is provided in the printer 1. However, the configuration of the image reading apparatus 2 is not limited to this configuration. For example, the image reading apparatus 2 may be an apparatus used independently from the printer 1 provided with a printing function.

Additionally, in each of the already-described embodiments, the description is given by using the electrophotography type printer 1. However, the present invention is not limited to this printer 1. For example, the present invention may also be applied to an inkjet type image forming apparatus that forms an image on a sheet by causing a nozzle to discharge a liquid ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-217797, filed Nov. 10, 2017, which is hereby incorporated by reference herein in its entirety.

What is claimed is:

1. An image reading apparatus, comprising:

a conveyance unit configured to convey a document;

a reading unit configured to read the document conveyed by the conveyance unit;

a discharge unit configured to discharge the document read by the reading unit in a discharge direction;

a supporting portion including a support surface which supports a lower surface of the document discharged from the discharge unit; and a conductive portion which is electrically conductive and connected to a ground potential, wherein the conductive portion is provided at the support surface, wherein the conductive portion includes an abutment surface that is able to abut the document supported by the supporting portion, and wherein an area of the abutment surface is smaller than an area of one surface of the document, to be conveyed, having a minimum size which can be read by the image reading apparatus.

2. The image reading apparatus according to claim 1, wherein the support surface includes a first surface inclined upward toward a downstream of the discharge direction, and a second surface arranged upstream of the first surface with respect to the discharge direction, the second surface forming a smaller angle with a horizontal plane than the first surface, and wherein the conductive portion is provided in the second surface.

3. The image reading apparatus according to claim 1, wherein the conductive portion is arranged upstream of a middle of the support surface with respect to the discharge direction.

4. The image reading apparatus according to claim 1, wherein the conductive portion is supported so as to be movable with respect to the supporting portion between a protruding position protruding above the support surface and a lower position below the protruding position, and is urged toward the protruding position.

5. The image reading apparatus according to claim 4, further comprising a detector which outputs a detection signal based on the conductive portion being located at the lower position, in order to detect whether or not the document is on the supporting portion.

6. The image reading apparatus according to claim 1, wherein the conductive portion comprises a sheet shaped member arranged on the support surface.

7. The image reading apparatus according to claim 1, wherein a length of the abutment surface in a width direction perpendicular to the discharge direction is shorter than a length of one surface of the document having the minimum size in the width direction.

8. The image reading apparatus according to claim 1, wherein the conductive portion is provided in the support surface.

9. An image reading apparatus comprising:

a document tray on which a document is placed;

a conveyance roller configured to convey the document on the document tray;

a reading unit configured to read the document conveyed by the conveyance roller;

a discharge roller configured to discharge the document read by the reading unit; and a discharging tray on which a discharged document is placed, the discharging tray being arranged under the document tray in a vertical direction, the discharging tray including:

a support surface supporting the document;

an upstream end wall which is provided upstream of the support surface with respect to a discharge direction of the document, and restricts a trailing edge of the discharged document; and a conductive portion provided at a position different from the upstream end wall with respect to the discharge direction so as to contact the document abutting the support surface, wherein the conductive portion includes an abutment surface that is able to abut the document supported by the supporting surface, and wherein an area of the abutment surface is smaller than an area of one surface of the document, to be conveyed, having a minimum size which can be read by the image reading apparatus.

10. The image reading apparatus according to claim 9, wherein the support surface includes a first surface inclined upward toward a downstream of the discharge direction, and a second surface arranged upstream of the first surface with respect to the discharge direction, the second surface forming a smaller angle with a horizontal plane than the first surface, and wherein the conductive portion is provided in the second surface.

11. The image reading apparatus according to claim 9, wherein the conductive portion is arranged upstream of a middle of the support surface with respect to the discharge direction.

12. The image reading apparatus according to claim 9, wherein the conductive portion is supported so as to be movable with respect to the discharging tray between a protruding position protruding above the support surface and a lower position below the protruding position, and is urged toward the protruding position.

13. The image reading apparatus according to claim 12, further comprising a detector which outputs a detection signal based on the conductive portion being located at the lower position, in order to detect whether or not the sheet is on the discharging tray.

14. The image reading apparatus according to claim 9, wherein the conductive portion comprises a sheet shaped member arranged on the support surface.

15. The image reading apparatus according to claim 9, wherein a length of the abutment surface in a width direction perpendicular to the discharge direction is shorter than a length of one surface of the document having the minimum size in the width direction.

* * * * *